US005154201A

United States Patent [19]

Yanagihara et al.

[11] Patent Number: 5,154,201

[45] Date of Patent: Oct. 13, 1992

[54] METHOD OF MANUFACTURING A SEALED VESSEL HAVING A SAFETY VALVE

[75] Inventors: Hiromu Yanagihara; Akiyoshi Yamashita, both of Osaka, Japan

[73] Assignee: Ajia Kinzoku Kogyo Co., Ltd., Osaka, Japan

[21] Appl. No.: 658,689

[22] Filed: Feb. 21, 1991

[30] Foreign Application Priority Data

Feb. 26, 1990 [JP] Japan ..... 2-46526
Nov. 2, 1990 [JP] Japan ..... 2-298603

[51] Int. Cl.[5] ..... F16K 17/38

[52] U.S. Cl. ..... 137/15; 137/72; 137/79; 220/89.4; 228/184

[58] Field of Search ..... 137/72, 79, 15; 220/89.4; 228/184, 246

[56] References Cited

U.S. PATENT DOCUMENTS 2,251,345 8/1941 Triplett ..... 220/89.4 X
3,168,210 2/1965 Williams ..... 220/89.4
3,245,578 4/1966 Sutton ..... 220/89.4
4,232,796 11/1980 Hudson, Jr. et al. ..... 137/72 X
4,240,573 12/1980 Hudson, Jr. ..... 228/184

FOREIGN PATENT DOCUMENTS 51-31606 9/1976 Japan .
55-36878 9/1980 Japan .
57-3674 1/1982 Japan .
60-45175 3/1985 Japan .

*Primary Examiner*—John Rivell
*Attorney, Agent, or Firm*—Steven M. Rabin

[57] ABSTRACT

A method of sealing a pressure vessel so that pressurized gas in the vessel is released if the temperature of the gas approaches a critical temperature. An end plate having a concave upper surface and a convex lower surface, is provided with a bore perforating the plate at a low point of the concave surface. A central portion of the plate surrounding the bore bending downwardly to the bore so as to define a cavity in the plate. The plate is oriented with the concave surface facing in an upward direction. An alloy pellet, having a melting point which is lower than the critical temperature, is provided onto the concave surface so that the pellet is gravitationally drawn to rest in the cavity. The end plate is then heated at a temperature higher that the melting point of the pellet so that the pellet is melted and plugs the bore. The end plate is then cooled to solidify the melted pellet in the cavity and in the bore. An open end of the vessel is then fitted with the end plate so as to seal the end closed, and the vessel is supplied with pressurized gas.

16 Claims, 4 Drawing Sheets

METHOD OF MANUFACTURING A SEALED VESSEL HAVING A SAFETY VALVE

FIELD OF THE INVENTION

This invention relates to a safety valve of a sealed vessel e.g. an aerosol vessel, which is filled with pressurized gas, especially to a safety valve for avoiding accidental explosion when the sealed vessel is overheated, and to a method for manufacturing the safety valve.

BACKGROUND OF THE INVENTION

When a pressurized, sealed vessel, e.g. an aerosol vessel which contains special liquid with a low boiling point and vapor of the liquid, is overheated to an abnormal extent, the sealed vessel would explode by abnormally high inner pressure. In order to avoid such an accidental explosion, a conventional pressurized, sealed vessel (1) is equipped with a safety valve at a bottom plate (11) as shown by FIG. 1. This safety valve consists of a port (15) bored at the center of the bottom plated (11), a valve body (20) for closing the outside of the port (15) and a spring (21) for pulling the valve body (20) inward. When the sealed vessel (1) is abnormally overheated and the inner pressure increases to over a predetermined critical pressure, the valve body (20) is opened by the action of the highly-pressurized gas. Then the pressurized gas spouts from the part (15), and the inner pressure decreases to below the critical pressure.

However such a conventional safety valve has structural drawbacks; complexity of structure: inconvenient operation for assembling the bottom plate (11) to a cylinder of the vessel and a high cost of parts. These drawbacks are caused by the fact that the safety valve requires a plurality of parts to be assembled besides the valve body (20). In addition, the safety valve has also a problem from the standpoint of safety. If the valve body and a shaft for sliding through a hole are left unmoved for a long time, the sliding shaft would occasionally adhere to the edge of the hole or the valve body would sometimes adhere to the valve seat for some reasons. Then the valve would not work even when it is overheated.

SUMMARY OF THE INVENTION

A purpose of the invention is to provide a safety valve with simplified structure. Another purpose of the invention is to provide a safety valve with high reliability.

A safety valve of a sealed vessel of this invention comprises a cavity formed on an outer surface of a bottom plate of the sealed vessel, a bore perforating the bottom plate in the cavity and plugging material made from an alloy with a low melting point frozen in the cavity including the bore. The melting point of the alloy is determined by the critical temperature at which the safety valve shall release the sealed vessel. Under the critical temperature, because the plugging material is kept in a solid state, the bore is closed and the vessel is sealed by the plugging material.

When the vessel is overheated to above the critical temperature, the plugging material is softened or melted by the heat, and blown away by the pressurized gas. Thus the bore is opened, the inner gas spouts from the vessel and the pressure in the vessel decreases to below a critical pressure. The fact that the plugging material is frozen on the outer surface of the bottom plate, secures the release action for the safety valve whenever it is overheated.

The structure of the safety valve of the sealed vessel is conspicuously simple, because it consists only of the cavity, the bore and the plugging material. The safety valve never fails to work in an abnormal state at any time long after construction, because it has no mechanical parts, e.g. no sliding shaft, no valve body nor a valve base as shown in FIG. 1. The function of the safety valve depends only on the phase transition of the plugging material. The temperature of the phase transition of metal never changes even for hundreds of years.

Of course, a safety valve should detect high inner pressure instead of high temperature, because it is provide for avoiding an accidental explosion. However in a sealed vessel containing volatile liquid or solid, since the volume of the vessel and the amount of volatile liquid or solid are kept constant, the inner pressure which is solely determined by the vapor pressure of the liquid at the temperature will increase according to the rise of the temperature. If the vessel contains neither volatile liquid nor solid, but only gas, the temperature is in proportion to the inner pressure from the teaching of the Boyle-Charles law. Then detecting high temperature is totally equivalent to detecting high inner pressure in a sealed vessel.

Another purpose of the invention is to provide a simple and reliable method with a high throughput for manufacturing a safety valve of a sealed vessel. To achieve this purpose, the method for manufacturing a safety valve of a sealed vessel of this invention comprises the steps of: shaping a cavity by deforming inwardly the center portion of a bottom plate which is bent inwardly, perforating the bottom plate to obtain a bore at the center of the cavity, holding the bottom plate with the cavity upward, supplying a pellet of an alloy with a low melting point into the cavity, heating the bottom plate for a certain time to above the melting point of the alloy for melting the pellet of the alloy into a melt and closing the bore with the melt, and cooling the bottom plate to solidify the melt into solid plugging material.

The functions of the steps are now explained.

At the early steps of the processes, the pellet never fails to be put into the cavity, because the bottom plate is held with its concave surface upward and the cavity upward also. Next the bottom plate is heated for a certain time at a temperature above the melting point. The pellet of the alloy is also heated and melted into a melt. The melt flows to the bottom of the cavity. The bore at the bottom is closed by the melt. Although the bore penetrates the bottom of the cavity, the melt does not drop down through the bore because of the surface tension of the melt, because the diameter of the bore is small. The melt has an upper horizontal surface in contact with air and a spherical bottom surface in contact with the cavity. Last, the bottom plate is cooled down to the room temperature. The melt is frozen into a solid with the same shape as the melt. The solid is called plugging material. The bore is closed by the plugging material.

By supplying the pellet of the alloy down into the cavity, the pellet is positioned just upon the hole and melted above the hole when it is heated, because the bottom plate and the cavity are supported with the concave surfaces upward. Then the bore is surely closed by frozen alloy without fail. Being immune from the occurrence of rejected articles, the method of this invention enjoys a high throughput.

A further purpose of the invention is to provide a method for heightening the airtightness of the plugging material. To achieve this purpose, the method comprises the additional steps: coating the inner surface of the bottom plate with a plastic layer having an opening in correspondence with the bore of the cavity before the processes mentioned. In this case, the melt will ooze through the bore to the lower side of the bore and will penetrate between the plastic layer and the bottom plate. Then when the bottom plate is cooled, a portion of the melt is frozen there. In the improvement, the bore is sealed both on the upper side and the lower side by the plugging material. The partially spherical surface of the plugging material is covered with the plastic layer. These facts heighten the airtightness of the vessel in a normal state.

DETAILED DESCRIPTION OF THE PREFERRED EMBODIMENTS

Figure 1:
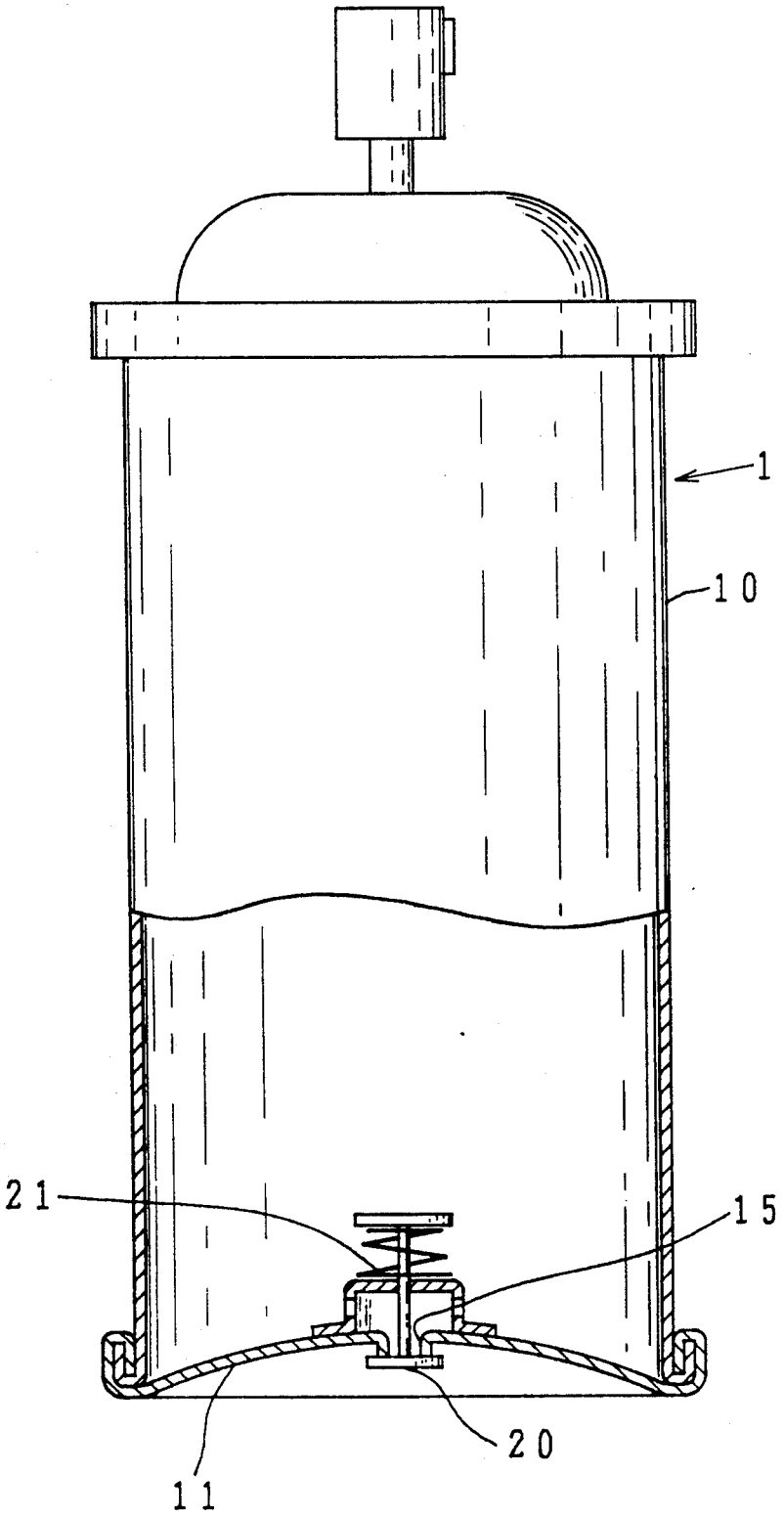
FIG. 1 is a partially sectioned front view of an aerosol vessel belonging to the prior art.
Figure 2:
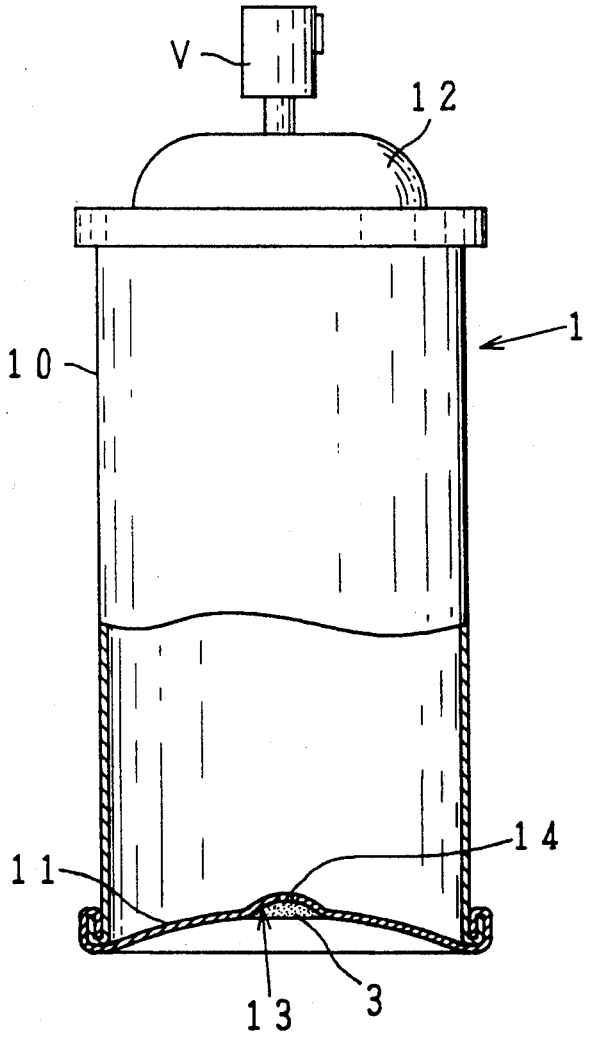
FIG. 2 is a partially sectioned front view of an aerosol vessel having a safety valve of this invention.
Figure 3:
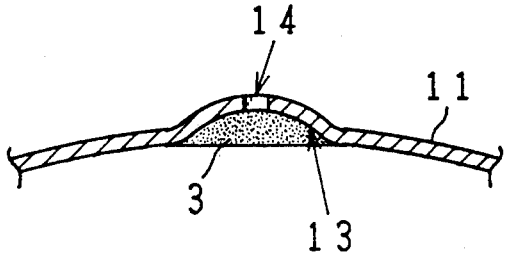
FIG. 3 is an enlarged sectional view of a portion of the bottom plate equipped with the safety valve of the invention.

Preferred embodiments of this invention are explained by the figures from FIG. 2 to FIG. 7. These embodiments relate to examples applied to an aerosol vessel. However this invention can be widely applied to any sealed vessels filled with highly pressurized gas. This aerosol vessel contains a liquid with a boiling point lower than the room temperature and a gas evaporated from the liquid. The pressure of the gas is equal to the vapor pressure of the liquid at the temperature thereof, because the gas and the liquid are in thermal equilibrium with each other. As the vessel is sealed, the pressure increases as the temperature rises, because the vapor pressure of the liquid increases as a predetermined function of the temperature. If the sealed vessel contains no liquid but only gas, the inner pressure increases according to the rise of temperature according to the Boyle-Charles law. In any case, the pressure of the sealed vessel containing highly-pressurized gas increases as the temperature rises.

A sealed vessel (1) comprises a cylinder (10), a top plate (12) fitted to the upper opening of the cylinder (10), an atomizing valve (V) equipped to the top end plate (12) and a bottom end plate (11) fitted to the lower opening of the cylinder (10).

Being made from aluminum, steal or other metal, the bottom plate (11) is a partial sphere which is bent inward. A cavity (13) further bent inward is formed at the center of the bottom plate (11). The cavity (13) is also a part of a small sphere and of course has a radius of curvature less than the radius of curvature of the remainder of the bottom plate. The fringe of the bottom plate (11) is fixed to the bottom end of the cylinder (10).

In this embodiment, the cavity (13) with a partial sphere shape is 5 mm to 8 mm in diameter, 1 mm to 2 mm in depth. The cavity has a bore (14) of 0.5 mm to 2.0 mm in diameter at the center. A plugging material (3) is frozen in the cavity for covering whole of the bottom surface of the cavity (13). The plugging material (3) is made from an alloy with a low melting point. The pertinent weight of the plugging material (3) is 0.3 g to 0.8 g. In this example, the depth of the plugging material (3) frozen in the cavity (13) is about 0.5 mm. The melting point of the alloy of the plugging material (3) should be determined to be an adequate temperature between 95° C. and 180° C. according to the purpose of the safety valve. Preferably the melting point of the alloy should be settled between 100° C. and 150° C. However in compliance with the condition for use, the melting point of the alloy can be settled at an arbitrary temperature either above 180° C. or below 95° C.

When the sealed vessel (1) is laid in a normal environment, the plugging material (3) tightly closes the bore (14) and the vessel is perfectly sealed, because the plugging material (3) is kept in a solid state. However when the temperature of the environment is raised and the sealed vessel is heated above a critical temperature, the plugging material (3) is either melted and falls from the cavity (13) or is softened and breaks down partially. In any case, the bore (14) is opened, the pressurized gas spouts from the vessel and the inner pressure decreases. Therefore an accidental explosion owing to abnormal high inner pressure can be avoided.

For example, a sealed vessel with a safety valve of the embodiment was produced under the following conditions:

cavity (13): 8 mm in diameter, 0.5 mm in depth
bore (14): 1.5 mm in diameter
plugging material (3): 0.8 mm in depth
alloy of the low melting point: 50 wt % of lead and 50 wt % of bismuth, melting point: 124° C.
temperature for operation of the safety valve: 120° C. to 124° C.
temperature for normal use of the vessel: 10° C. to 40° C.

When the sealed vessel (1) was heated to 120° C. at the surface, the plugging material (3) was broken at the bore (14) and the pressure in the vessel decreased. This test proved the reliable work of the safety valve.

Figure 4:
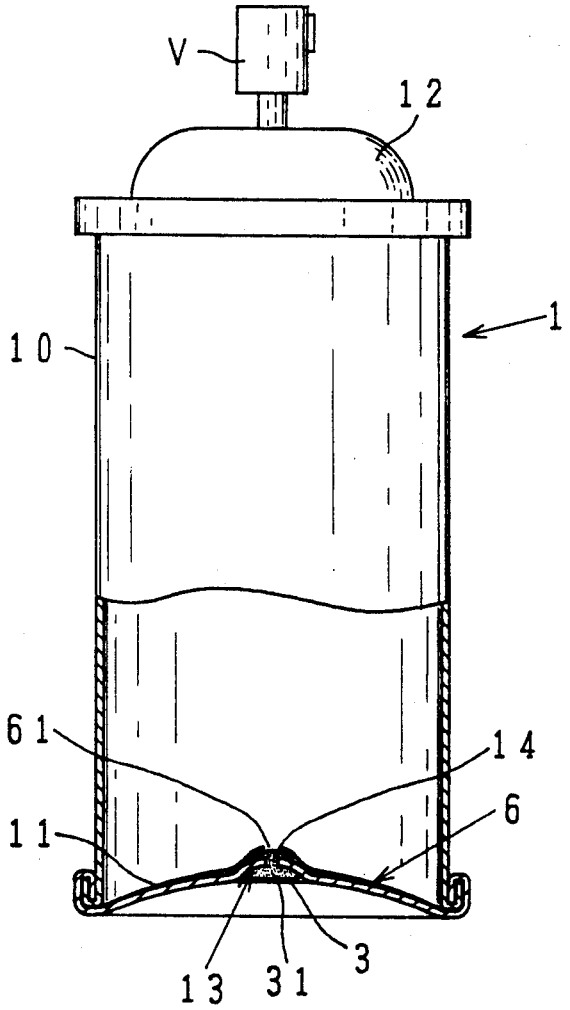
FIG. 4 is a partially sectioned front view of the aerosol vessel having the bottom plate with an inner surface coated with a plastic layer.
Figure 5:
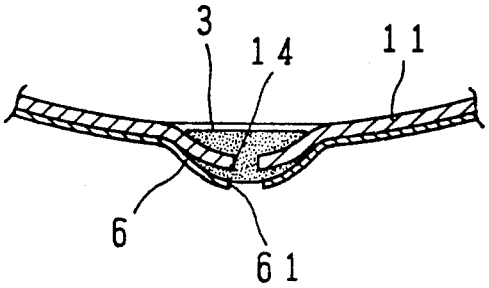
FIG. 5 is an enlarged sectional view of a portion of the bottom plate of the vessel shown in FIG. 4.

FIG. 4 and FIG. 5 show another embodiment in which a plastic later (6) is coated on the inner convex surface of the bottom plate (11). The melted alloy diffuses into a small umbrella-shaped space between the plastic layer (6) and the inner surface of the bottom plate (1) and is frozen there. In the embodiment, the bore (14) is threefold sealed firstly by the upper portion of the plugging material (3), secondly by the middle portion in the bore, and thirdly by the lower portion thereof. Besides, the plastic layer (6) also contributes to the airtightness of the vessel by covering the upper portion of the plugging material (3).

Therefore, the embodiment is superior to the former one in its airtightness in a normal state because of the threefold seal and the additional seal of the plastic layer. When the vessel is heated above a critical temperature, the plugging material (3) is melted and the gas flows through the opening (61) of the plastic layer (6) and the bore (14) of the cavity (13) to the external space. Thus this embodiment also works as a safety valve in the same way as the former embodiment of FIG. 2 and FIG. 3.

Figure 7:
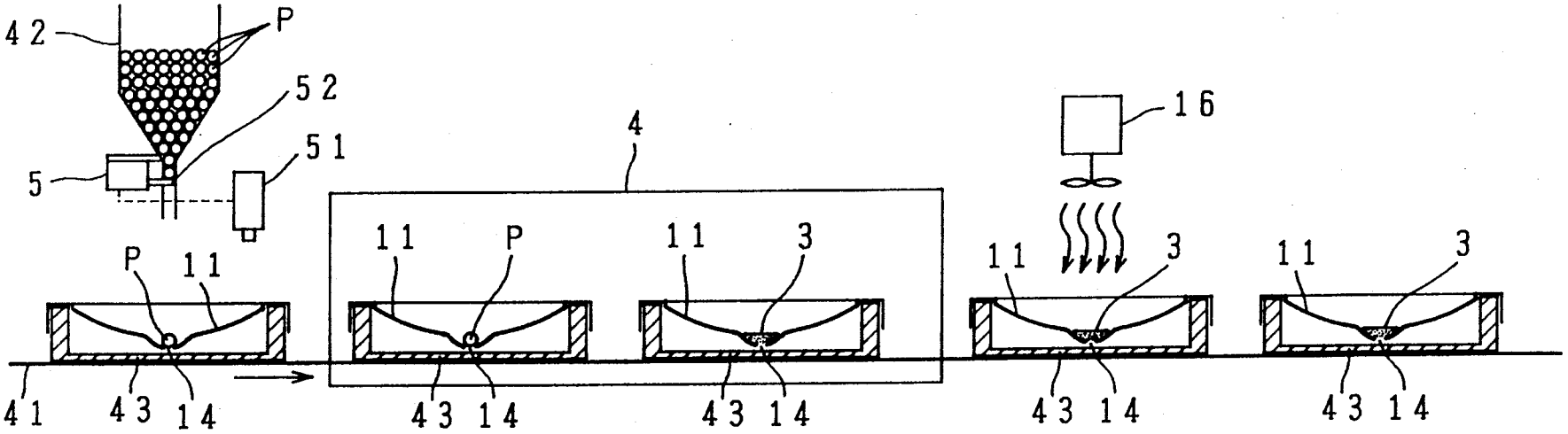
FIG. 7 is a schematical view of the processes for manufacturing the safety valve of this invention.

The method for providing the plugging material (3) in the bottom plate (11) is now explained by FIG. 7. A conveyer belt (41) is installed in a horizontal direction. A horizontal furnace (4) having an inlet and an outlet on reverse sides is positioned midway along the conveyor belt (41). A hopper (42) storing plenty of pellets (P) of an alloy with a low melting point is mounted above the beginning end of the conveyer belt (41). A cooling fan (16) is installed after the furnace (4) along the conveyer belt (41). Many carriages (43) are fixed on the conveyer belt (41) with a common interval therebetween. The bottom plates (11) are laid on the carriage (43) and are sent forward on the conveyer belt (41).

A supplying device (5) furnished at the outlet of the hopper (42) drops the pellets (P) of the alloy one-by-one. A detector (51) installed near the hopper (42) above the conveyer belt (41) detects the existence of the carriage (43) electro-optically or by a physical contact of a switch terminal. The detector (51) is connected to the supplying device (5) for giving a timing signal to drop a pellet (P).

The conveyer belt (41) moves forward continuously or intermittently at a constant velocity. When the detector (51) detects that the carriage (43) with the botttom plate (11) is positioned just below the hopper (42), the output signal of the detector (51) triggers the supplying device (5) for opening the shutter (52) to drop a pellet (P) into the bottom plate (11). This supplying operation is repeated with a constant rate.

The pellet (P) may not fall exactly into the cavity (13), but as the bottom plate (11) with a partial sphere shape is mounted upside down on the carriage (43), and the cavity (13), and bore (14) therein are at the lower point of the concave upper surface of the plate and thus lower than the remaining parts of bottom plate, a sphere-shaped pellet (P) rolls down on the bore (14) in the cavity (13).

The carriage (43) carries the bottom plate (11) with the pellet (P) on the bore (14) into the furnace (4) according to the movement of the conveyer belt (41). The temperature of the atmosphere in the furnace is set to be higher than the melting point of the alloy of the pellet (P). The length of the furnace is also determined to be long enough to melt the pellet at the temperature in the furnace. Thus the pellet (P) in the cavity (13) of the bottom plate (11) is melted. The second carriage (43) in the furnace (4) in FIG. 7 shows this state, where a melt fills in the cavity. It is important that melt never drops down from the bore (14) in this state. The diameter of the bore (14) is so small that the surface tension of the melt is strong enough to support itself above the bore.

Then the carriage (43) comes out of the furnace (4). The cooling fan (16) cools the bottom plate (11) to freeze the melt into a solid. The solidified material (3) plugs the bore (14). The bottom plate (11) is taken off from the carriatge (43). By another machine (not shown in the figures), the bottom plate (11) will be fitted to the bottom end of a cylinder (11) having the top plate (12). A sealed vessel (1) is thus accomplished.

Another embodiment shown in FIG. 4 and FIG. 5 is also produced by the same apparatus and method.

Figure 6:
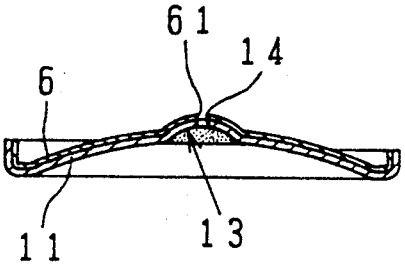
FIG. 6 is a sectional view of a bottom plate having an inner surface coated with a plastic layer.

In this case, another bottom plate (11) with an inner surface coated with a plastic layer (6) shown in FIG. 6 is used. To make the bottom plate (11), a flat metal sheet coated with the plastic layer (6) is cut into round plates with determined size and shape. The round plates are pressed into the shape with a partial sphere having a small partial sphere and a bore. The opening (61) of the plastic layer (6) and the bore (14) of the bottom plate (11) are perforated at the same time.

The melting point of the plastic layer (6) should be set higher than the melting point of the plugging material (3) as a matter of course. Besides, it is perferable that the softening point of the plastic layer (6) is also higher than the melting point of the plugging material (3).

For example, for the alloy with a melting point between 100° C. and 150° C., epoxy-phenol resin can be used as a material of the plastic layer (6), because the melting point and the softening point of epoxy-phenol resin is higher than 150° C.

The critical tempertures at which the safety valve shall work are different with regard to the kind and the purpose of the sealed vessel, and the kind of thermoplastics should be chosen in compliance with the critical temperature.

When the carriage (43) carries a bottom plate (11) coated with the plastic layer (6) on its inner surface into the furnace (4) with the movement of the conveyer belt (41), the pellet (P) is melted and is filled in the cavity (13). The atmospheric temperature of the furnace (4) is determined to be a temperature equal to or higher than the softening temperature of the plastic layer (6) but lower than the melting point of the plastic layer (6). Preferably the atmospheric temperature should coincide with the softening temperature of the plastic layer (6).

Accordingly, the melt of the alloy oozes through the bore (14) to the lower surface of the cavity (13) and penetrates into a small space between the plastic layer (6) and the lower surface of the cavity (13). When the melt is frozen, the plugging material fitted on the lower surface is partially coated by the plastic layer (6) as shown in FIG. 5. The reason why the melt penetrates into the space between the plastic layer (6) and the lower surface of the bottom plate (11) has not clearly been explained yet. It is assumed that when the plastic layer (6) is heated near the softening temperature, adhesive force between the plastic layer and the metal is perhaps weakened. The surface tension of the melt overcomes the adhesive force. With peeling of the plastic layer (6), the melt penetrates into the small space between the plastic layer (6) and the metal by capillary action which is based on the same physical principles as is the surface tension.

In the case a of epoxy-phenol resin coating on the bottom plate as a plastic layer, about 250° C. of the atmospheric temperature of the furnace (4) enables the melt to penetrate into the space between the plastic material and the metal to an adequate extent.

Then the carriage (43) comes out from the furnace (4) and is cooled by the cooling fan (16). The melt is frozen at three regions; in the cavity: in the bore and in the small space between the plastic layer and the metal. Thus the bore (14) is closed threefold. A sealed vessel is accomplished by fixing the bottom plate (11) having the plugging material (3) to the cylinder (10) with the top plate (12) like the former embodiment.

In the case of an aerosol vessel, highly-pressurized gas is filled into the vessel by a conventional method. If necessary, an additional valve for filling pressurized gas may be installed at a pertinent spot of the the bottom plate (11). If the pressurized gas can be supplied into the vessel through the hole of the atomizing valve (V), no additional valve is required.

Various kinds of alloys, e.g. solder, can be used as the plugging material. In general, such alloys consisting of bismuth (Bi), lead (Pb) and tin (Sn) are known well as alloys with a low melting point. The melting point of the alloy is arbitrarily chosen by changing the ratio of compounds. Such an alloy which melts at a temperature as low as 50° C. can be produced.

Although the embodiments are the examples of an aerosol vessel, this invention can be applied to other kinds of sealed vessels. The bottom plate (11) which is only required to have a center portion bent inward can be shaped like a cone instead of a partial sphere. The cavity (13) can also be replaced by a cone.

Furthermore the pellets (P) can be supplied by a hand of an operator instead of the supplying device (5) synchronized with the detector (51). The melt can naturally be cooled by being left in a room temperature environment instead of by using the cooling fan (16).

In the example, the plastic layer (6) is deposited on the bottom plate by a coating method, that is, painting a hot liquid of plastic on a plate and cooling the liquid into a solid layer. However, a laminating method, that is, adhering a plastic sheet onto a plate with adequate adhesive, is also available.

In FIG. 7, only the bottom plates (11) are mounted on the dish-like carriage, because the bottom plates can be later fixed to the cylinder (10) already fitted with the top plate (12). But in the case of the vessels in which the top plate (12) shall be fitted to the cylinder (10) in a later process, the bottom plates (11) assembled with the cylinder (10) are mounted on the carriage (43).

What we claim is;

1. A method for manufacturing a safety valve of a sealed vessel for releasing pressurized gas from the sealed vessel in an abnormally heated state being defined by a critical temperature, comprising the step of: bending a bottom plate into a partial sphere or into a cone, with a concave surface and a convex surface, shaping a cavity of a partial sphere or of a cone by bending a central portion of the bottom plate in a direction from the concave surface toward the convex surface, perforating the bottom plate to provide a bore at a central portion of the cavity, holding the bottom plate with the convace surface facing upward, supplying onto the concave surface a pellet of an alloy with a melting point lower than the critical temperature of the abnormally heated state, heating the bottom plate for a certain time at a temperature higher than the melting point of the alloy, melting the pellet into a melt for plugging the bore of the cavity, cooling the bottom plate for freezing the melt in the cavity and the bore, fitting the bottom plate to an open end of the vessel to be sealed and supplying the vessel with pressurized gas.

2. A method for manufacturing a safety valve of a sealed vessel according to claim 1, wherein the metal plate is coated with a plastic layer on the concave surface, said step of heating comprising the step of heating the bottom plate for a certain time at a temperature higher than the melting point of the alloy but lower than the melting point of the plastic layer, said step of melting comprising the step of melting the pellet of the alloy into a melt for flowing through the bore, peeling a portion of the plastic layer and penetrating into a small space between the plastic layer and the bottom plate, said step of cooling comprising the step of cooling the bottom plate for freezing the melt in the cavity in the bore and in the small space between the plastic layer and the bottom plate.

3. A method as claimed in claim 2, wherein the temperature of heating the bottom plate is almost equal to the softening temperature of the plastic layer (6).

4. A method as claimed in claim 2, wherein the plastic layer (6) is made from epoxy-phenol resin and the temperature of heating the bottom plate is about 250° C.

5. A method of forming a pressure vessel so that pressurized gas in the vessel is released through a safety valve if the temperature of the gas approaches a critical temperature, comprising the steps of:

a. providing an end plate having a concave surface and a convex surface opposite the concave surface, a bore perforating the plate at a low point of the concave surface, a central portion of the plate surrounding the bore bending to the bore so as to defined a cavity in the plate which opens toward the concave surface;

b. orienting the plate with the concave surface facing in an upward direction;

c. supplying an alloy pellet on the concave surface so that the pellet is gravitationally drawn to rest in the cavity, the pellet having a melting point which is lower than the critical temperature;

d. heating the end plate at a temperature higher that the melting point of the pellet so that the pellet is melted and plugs the bore;

e. cooling the end plate to solidify the melted pellet in the cavity and in the bore;

f. after said step e, fitting an open end of the vessel with the end plate so as to seal the end closed; and g. supplying the vessel with pressurized gas, the solidified melted pellet and bottom plate forming the safety valve for the vessel.

6. A method according to claim 5, wherein the plate is substantially in the shape of a first partial sphere.

7. A method according to claim 6, wherein the central portion of the end plate is substantially in the shape of a second partial sphere having a radius of curvature smaller than a radius of curvature of the first partial sphere.

8. A method according to claim 7, wherein the cavity has a diameter in the range of 5 to 8 mm. and a depth in the range of 1 to 2 mm, the bore having a diameter in the range of 0.5 to 2 mm.

9. A method according to claim 5, wherein the end plate is substantially conical.

10. A method according to claim 5, wherein the central portion of the end plate is substantially in the shape of a partial sphere.

11. A method according to claim 5, wherein the central portion of the end plate is substantially concial.

12. A method according to claim 5, wherein the pellet is spherical and said step c comprises the step of placing the pellet at a location on the concave surface which is outside of the cavity, so that the pellet rolls by gravity into the cavity.

13. A method according to claim 5, wherein said step f comprises the step of fitting the open end of the vessel with the end plate so as to seal the end closed with the convex surface of the end plate facing into the vessel.

14. A method according to claim 5, further comprising the step of coating a plastic layer onto the convex surface of the plate before said step c; a peelable portion of the plastic layer coating including a bottom surface portion of the central portion of the plate, the plastic layer having a melting point higher than the melting point of the alloy pellet; said step of heating comprising the step of heating the end plate to a temperature which is higher than the melting point of the pellet and lower than the melting point of the plastic layer, so that a portion of the melted pellet flows through the bore, peels the peelable portion from the bottom surface portion and penetrates a small space between the peeled portion and the bottom surface portion; said step g including the step of cooling the end plate to solidify the portion the melted pellet in the small space.

15. A method according to claim 14, wherein the plastic sheet has a softening temperature and the temperature at which the plate is heated is almost equal to the softening temperature.

16. A method according to claim 15, wherein the plastic layer is made from epoxy-phenol resin and the temperature at which the end plate is heated is about 250 degrees C.

* * * * *